United States Patent [19]

Park

[11] Patent Number: 4,833,284

[45] Date of Patent: May 23, 1989

[54] POWER RELAY SWITCHING CONTROL DEVICE FOR MICROWAVE OVEN

[75] Inventor: Jong I. Park, Kyungsangnam-do, Rep. of Korea

[73] Assignee: Gold Star Co., Ltd., Seoul, Rep. of Korea

[21] Appl. No.: 55,526

[22] Filed: May 29, 1987

[30] Foreign Application Priority Data

May 31, 1986 [KR] Rep. of Korea ..... 4364/1986

[51] Int. Cl.[4] ..... H05B 6/68

[52] U.S. Cl. ..... 219/10.55 B; 219/10.55 R; 307/127; 323/908; 361/185; 361/208

[58] Field of Search ..... 219/10.55 B, 10.55 C, 219/10.55 R, 10.77, 497; 307/127, 129, 139, 140; 323/300, 908; 361/3, 5–7, 182, 185, 186, 170, 160, 208, 209

[56] References Cited

U.S. PATENT DOCUMENTS

| | | | |
|---|---|---|---|
| 3,018,414 | 1/1962 | Albright | 361/3 |
| 3,237,055 | 2/1966 | Riordan | 361/186 X |
| 3,601,688 | 8/1971 | Dogadko | 323/300 X |
| 3,646,439 | 2/1972 | Broski | 323/300 X |
| 4,074,101 | 2/1978 | Kiuchi et al. | 219/10.55 B X |
| 4,153,922 | 5/1979 | Azuma et al. | 361/185 X |
| 4,296,449 | 10/1981 | Eichelberger | 361/3 |
| 4,300,032 | 11/1981 | Niu et al. | 219/10.55 B |
| 4,339,656 | 7/1982 | Yamakido | 307/127 X |
| 4,405,904 | 9/1983 | Oida et al. | 219/10.55 R X |
| 4,543,493 | 9/1985 | Stanley et al. | 307/140 X |

*Primary Examiner*—Philip H. Leung

*Attorney, Agent, or Firm*—Birch, Stewart, Kolasch & Birch

[57] ABSTRACT

A power relay for a switching control device of a microwave oven, designed to prolong the life of the power relay by alternately carrying out the drive of the power relay used for controlling the power in a microwave oven at the positive (+) cycle and the negative (−) cycle of the alternating current input voltage, respectively. The output signal of the 50 Hz/60 Hz clock generator for generating the clock signal corresponds to the frequency of the alternating current input voltage and is combined with the output signal of the power relay ON/OFF generator. The power relay ON/OFF control part is composed so as to alternately realize the ON-point and the OFF-point of power relay at the positive cycle and the negative cycle of the alternating current input voltage, respectively, so that no potential difference takespace in one direction between contact of the power relay, and the life is thereby prolonged.

5 Claims, 3 Drawing Sheets

FIG, 1
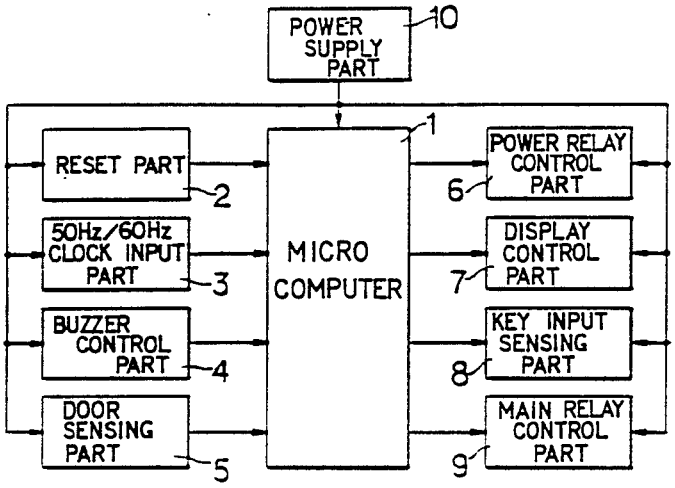
FIG, 2
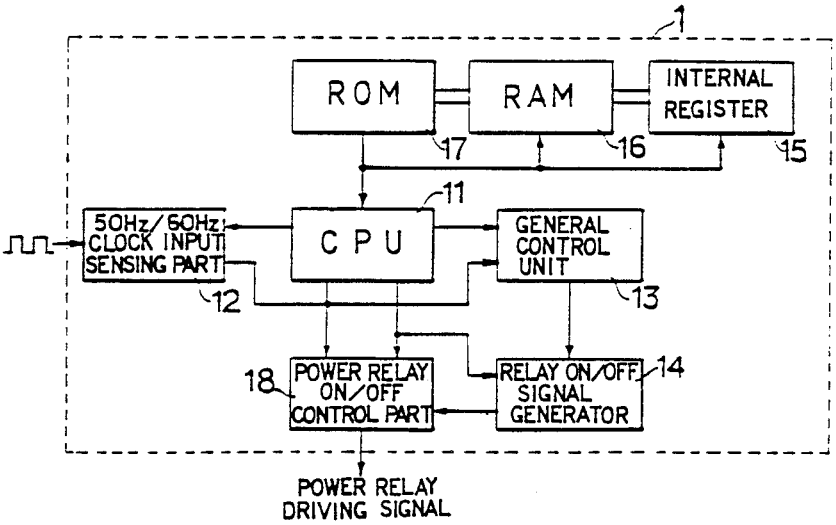

FIG,3
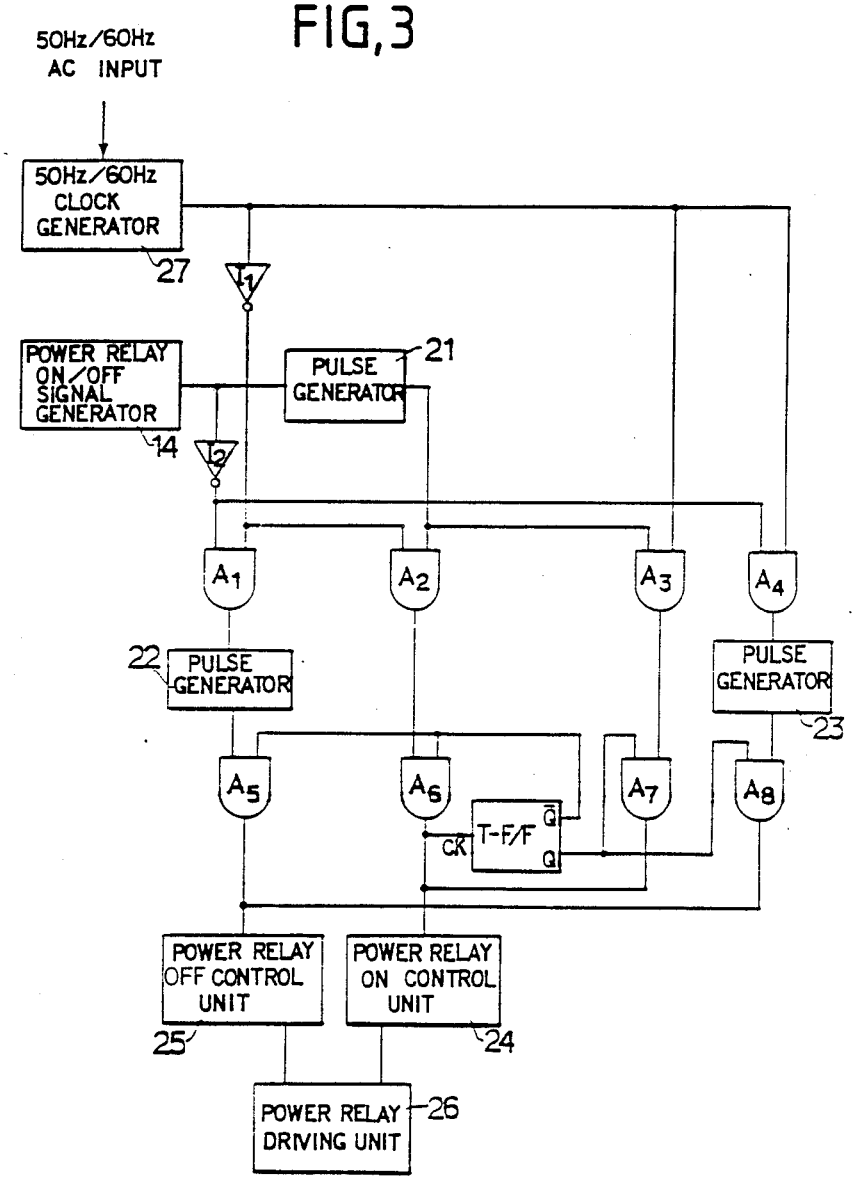

FIG, 4
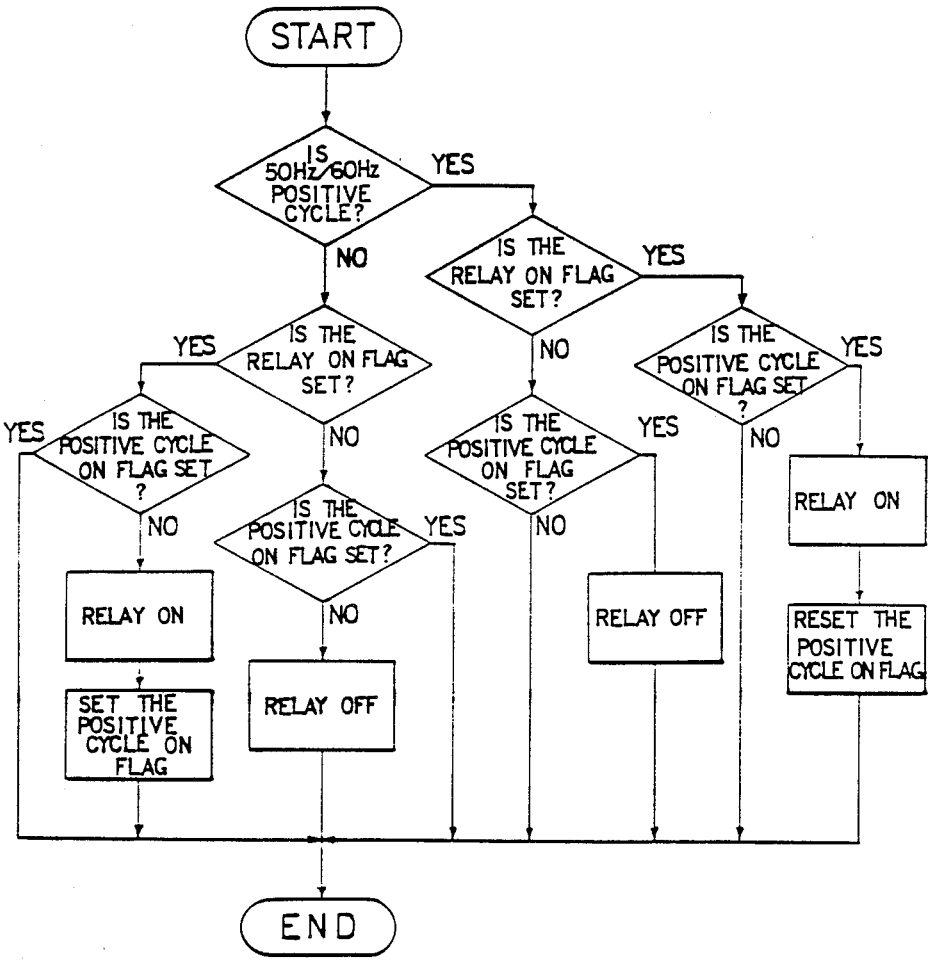

POWER RELAY SWITCHING CONTROL DEVICE FOR MICROWAVE OVEN

FIELD OF THE INVENTION

The present invention relates to a switching (ON/-OFF) control device of the power relay used for power control in a microwave oven. The present invention particularly relates to a power relay switching control device for a microwave oven designed to prolong the life of the power relay by carrying out the drive of power relay alternately between the positive(+) cycle and the negative(−) cycle of the alternating current input voltage.

BACKGROUND OF THE INVENTION

According to the conventional microwave oven, it is designed to control the output of the magnetron by switching the alternating current voltage inputted to the high voltage transformer through the triac or relay so that it is possible to minimize the excess inrush current by carrying out a switching operation at the $\pi/2$ crossing point of the alternating current input voltage.

In a case where the triac is used for controlling the power supply, it is possible to carry out an exact switching at the $\pi/2$ crossing point of the alternating current input voltage due to a rapid and constant answering speed of the triac.

However, in such a case, there is a disadvantage in that it needs a radiating plate for radiating the heat produced from the triac, which makes the whole structure more complicated, and moreover, since the triac is expensive, the cost is higher.

Furthermore, in a case where a relay is used for controlling the power supply, there is also a disadvantage in that the answering speed of the relay is late and the answering speed is not constant depending on the characteristics of the relay. Therefore, it is impossible to carry out an exact switching at the $\pi/2$ crossing point of the alternating current input voltage and an excess inrush current is thereby increased at the time of switching. At this moment, a driving signal of the relay is output for a constant period, the drive of relay is continuously made for only one of the positive or negative cycles of the alternating current input voltage so that a phenomenon of potential difference takes place only in a direction between contacts of the relay, and thereby the life of the contacts of the relay is shortened.

SUMMARY OF THE INVENTION

The present invention is created to solve such conventional disadvantages as described above. The object of this invention is to provide a switching control device capable of prolonging the life of the relay by driving the relay for power control of a microwave oven alternately between the positive and negative cycles of the alternating current input voltage.

According to the invention, such an object is attained in a way that when an ON signal of the relay is generated, the relay is driven for the negative cycle of the alternating current input voltage. When an OFF signal of the relay is thereafter generated, the drive of the relay is interrupted from the positive cycle of the alternating current input voltage. When a new ON signal of the relay is thereafter generated, the relay is driven for the positive cycle of the alternating current input voltage. When a new OFF signal of the relay is thereafter generated, the drive of the relay is interrupted from the negative cycle of the alternating current input voltage.

According to the present invention mentioned thus far, the relay for power control of a microwave oven begins to be driven alternately between the positive and negative cycles of the alternating current input voltage, and its drive is interrupted alternately between the positive and negative cycles of the alternating current input voltage so that no phenomenon of potential difference does not take place in a direction between the contacts of relay, and the life of relay is thereby prolonged.

BRIEF DESCRIPTION OF THE DRAWINGS

The construction and operational effects of the invention will now be described in more detail, by way of example, with reference to the accompanying drawings. In the drawings, FIG. 1 is a block diagram of a control device of a microwave oven according to the invention;

FIG. 2 is an internal block diagram of the microcomputer of FIG. 1;

FIG. 3 is a detailed circuit diagram of the power relay ON/OFF control part of FIG. 2;

FIG. 4 is a flow chart to describe the operation of FIG. 3.

DETAILED DESCRIPTION OF THE PREFERRED EMBODIMENTS

As is shown in FIG. 1, which is a block diagram of a control device of a microwave oven according to an embodiment of the invention, the control device comprises a power supply part 10 for supplying power to each part, a reset part 2, a 50 Hz clock input part 3, a buzzer control part 4, a door sensing part 5, a power relay control part 6 designed to regulate the output of magnetron by switching the power supply of the high voltage transformer, a display control part 7, a key input sensing part 8 and a main relay control part 9, all of which are connected to a microcomputer 1.

As is shown in FIG. 2, which is a block diagram of a microcomputer 1 of FIG. 1, the microcomputer comprises a central processing unit 11, a 50 Hz/60 Hz clock input sensing part 12, a general control part 13, a power relay ON/OFF signal generator 14, an internal register 15, a RAM 16, a ROM 17 and a power relay ON/OFF control part 18.

As is shown in FIG. 3, which is a detailed circuit diagram of the power relay ON/OFF control part shown in FIG. 2, the output side of the 50 Hz/60 Hz clock generator 27 generates a clock signal corresponding to an alternating current input of 50 Hz/60 Hz. The output of the 50 Hz/60 Hz clock generator 27 is connected to the input terminal on one side of the AND-gates A3, A4 and at the same time to the input terminal on one side of the AND-gates A1, A1 through the inverter I1. The output side of the power relay ON/OFF signal generator 14 is connected, on the one hand, to the input terminal on the opposite side of the AND-gates A1, A4 through the inverter I2 and, on the other hand, to the input terminal on the opposite side of the AND-gates A2, A3 through the pulse generator 21. The output terminals of the AND-gates A1, A4 are connected to the input terminal on one side of the AND-gates A5, A8 through the pulse generators 22, 23, respectively. The output terminals of the AND-gates A2, A3 are connected to the input terminal on one side of the AND-gates A6, A7. The input terminals on the opposite sides of the AND-gates A5, A6, are connected to the output terminal Q and the output terminals of the AND-gates A6, A7 are connected in common to the toggle input terminal K of the said toggle flip-flop T-F/F and to the input side of the power relay ON control unit 24. The output terminals of the AND-gates A5, A8 are connected to the input side of the power relay OFF control unit (25). The output sides of the power relay ON and OFF control units 24, 25 are connected to the set and reset terminals S, R of the power relay driving unit 26, wherein the pulse generators 21, 22, 23 are kinds of differential circuits designed to eliminate the negative pulse signals and to output only the positive signals. The power relay ON and OFF control units 24, 25 are monostable multivibrators designed to output pulse signals of a constant time as the pulse signals are put in the input sides thereof, and the power relay driving unit 26 comprises a flip-flop designed to come to a set state to turn on the power relay when a high potential signal is applied to its set terminal S, while to come to a reset state to turn off the power relay when a high potential signal is applied to its reset terminal R.

The operational effects of the composed invention are now described in more detail.

While high potential signals which are positive(+) cycles, are output from the 50 Hz/60 Hz clock generator 27, the high potential signals are reversed to low potential signals at the inverter I1 and are applied to the input terminals of the AND-gates A1, A2 so that the low potential signals are output from the output terminals of the AND-gates A1, A2, A5, A6 regardless of the output signals of the power relay ON/OFF signal generator 14. On the contrary, while low potential signals which are negative(−) cycles, are output from the 50 Hz/60 Hz clock generator (27), the low potential signals are applied to the input terminals of the AND-gates A3, A4 so that low potential signals are output from the output terminals of the AND-gates A3, A4, A7, A8 regardless of the output signals of the power relay ON/-OFF signal generator (14).

When a high potential signal, which is a power relay ON signal, is output from the power relay ON/OFF signal generator (14), the high potential signal is reversed to a low potential signal at the inverter I2 and applied to the input terminal of the AND-gates A1, A4 so that a low potential signal is output from the output terminals of the AND-gates A1, A4, and as a high potential signal output from the power relay ON/OFF signal generator 14 is input the pulse generator 21, a pulse signal is output from the pulse generator 21 and applied to the input terminal of the AND-gates A2, A3. Accordingly as described above, while low potential signals are output from the 50 Hz/60 Hz clock generator 27, the pulse signal output from the said pulse generator 21 is applied to the input terminal of the AND gate A6 through the AND gate A2. At this time the toggle flip-flop T-F/F is in the initial state and a high potential signal output from its output terminal $\overline{Q}$ is applied to the input terminal on the opposite side of the AND gate A6 so that a pulse signal is output from AND gate A6 and applied to the power relay ON control unit 24.

Accordingly, as a high potential pulse signal of a constant time period is output from the power relay ON control unit 24 and applied to the set terminal S of the power relay driving unit 26, the power relay driving unit 24 comes to a set state to turn on the power relay.

On the other hand, since a pulse signal outputted from the AND gate A6 is, at this time, applied to the toggle input terminal CK of the toggle flip-flop T-F/F, a low potential signal is output from the toggle flip-flop T-F/F output terminal $\overline{Q}$ and a high potential signal is output from the output terminal Q, and accordingly a low potential signal is output from the AND gate A6.

Subsequently, when a low potential signal, which is a power relay OFF signal, is output from the power relay ON/OFF signal generator 14, the low potential signal is reversed to a high potential signal at the inverter I2 and applied to the input terminal on one side of the AND gate A4. Accordingly, when a high potential signal which is the positive(+) cycle, is output from the 50 Hz/60 Hz clock generator 27, as described above, a high potential signal is output from the AND gate A4 and applied to the pulse generator 23 so that a pulse signal is output from the pulse generator 23. Since a high potential signal is, at this time, output from the output terminal Q of the toggle flip-flop T-F/F and applied to the input terminal of the AND gate A8, the pulse signal output from the pulse generator 23 is applied to the input terminal of the power relay OFF control unit 25 through the AND gate A8. Accordingly, as a high potential signal of a constant time period is output from the power relay OFF control unit 25 and applied to the reset terminal R of the power relay driving unit 26, this unit 26 is reset so as to turn off the power relay.

Subsequently, when a high potential signal which is a power relay ON signal, is again output from the power relay ON/OFF signal generator 14, a pulse signal is output from the pulse generator 21, as described above, and this pulse signal is applied to the input terminal of the power relay ON control unit 24 through the AND gates A3, A7 when a high potential signal of a positive(+) cycle is output from the 50 Hz/60 Hz clock generator 27 as described above, so that the power relay driving unit 26 comes to a set state to turn on the power relay again. At this time, the pulse signal outputted from the AND gate A7 is applied to the toggle input terminal CK of the toggle flip-flop T-F/F so that a high potential signal is output from the output terminal $\overline{Q}$ of the flip-flop T-F/F, and a low potential signal is output from the output terminal Q, and accordingly a low potential signal is put out of the output terminal of the AND gates A7, A8.

Thereafter, when a low potential signal which is a power relay OFF signal, is again output from the power relay ON/OFF signal generator 14, a pulse signal is output from the pulse generator 22 at the time a low potential signal is output from the 50 Hz/60 Hz clock generator 27 in such way as described above, and this pulse signal is applied to the power relay OFF control unit 25 through the AND gate A5 so that the power relay driving unit 26 is reset to turn off the power relay.

The above-described operation can be represented in a flowchart as shown in FIG. 4.

As described above, the present invention effects the ON-point of the power relay for controlling the input power of a high voltage transformer and is realized alternating between the positive and negative cycles of the alternating current input voltage, and the OFF-point of the power relay is also realized by alternating between the positive and negative cycles of the alternating current input voltage. Therefore, a phenomenon of potential difference does not occur in a direction between contacts of the power relay, and the life of the power relay is thereby prolonged, and further radiating plates, etc. are not used, which are required when using a triac, and this fact leads to a reduction of the cost.

What is claimed is:

1. A switching control apparatus for driving a power relay in a microwave oven, said power relay having mechanical switching contacts susceptible to arcing, comprising:

clock generator means for generating a clock signal having a positive cycle and a negative cycle of a frequency corresponding to an alternating current input voltage signal input to a high voltage transformer of the microwave oven;

power relay control means, operatively connected to said clock generator means, for generating a first control signal in response to a first positive cycle of said clock signal and a second control signal during a subsequent positive cycle of said clock signal; and alternate signal driving means, operatively communicating with said power relay control means and the power relay, for developing a drive signal for alternatively driving the power relay, said drive signal being generated in response to one of said positive and negative cycles and inhibited in response to the other of said positive and negative cycles during said first control signal and said drive signal being generated in response to said other of said positive and negative cycles and inhibited for said one of said positive and negative cycles during said second control signal.

2. A switching control apparatus according to claim 1, wherein said clock generator means generates a 50 Hz/60 Hz signal.

3. A switching control apparatus according to claim 1, wherein said alternate signal driving means comprises:

first logical means for developing an output signal responsive to logically multiplying an inversion of said clock signal and an inversion of said control signal;

second logical means for developing an output signal responsive to logically multiplying said inversion of said clock signal and said control signal;

third logical means for developing an output signal responsive to logically multiplying said clock signal and said control signal;

fourth logical means for developing an output signal responsive to logically multiplying said clock signal and said inversion of said control signal;

fifth logical means for developing an output signal responsive to logically multiplying said output of said first logical means and a first toggle signal;

sixth logical means for developing an output signal responsive to logically multiplying said output of said second logical means and said first toggle signal;

seventh logical means for developing an output signal responsive to logically multiplying said output of said third logical means and a second toggle signal;

eighth logical means for developing an output signal responsive to logically multiplying said output of said fourth logical means and said second toggle signal; and toggle means for developing said first and second toggle signals responsive to said outputs of said sixth and seventh logical means;

said drive signal being generated in response to said outputs of said sixth and seventh logical means and said drive signal being inhibited in response to said fifth and eighth logical means.

4. A switching control apparatus according to claim 3, wherein said toggle means is a flip-flop.

5. A switching control apparatus according to claim 3, wherein said first through eighth logical means are AND gates.

* * * * *